US009263817B2

(12) United States Patent
Palaniappa et al.

(10) Patent No.: US 9,263,817 B2
(45) Date of Patent: Feb. 16, 2016

(54) ADAPTER APPARATUS WITH SUSPENDED CONDUCTIVE ELASTOMER INTERCONNECT

(71) Applicant: Ironwood Electronics, Inc., Eagan, MN (US)

(72) Inventors: Ilavarasan M. Palaniappa, Rosemount, MN (US); Sue Min Huang, Apple Valley, MN (US)

(73) Assignee: IRONWOOD ELECTRONICS, INC., Eagan, MN (US)

( * ) Notice: Subject to any disclaimer, the term of this patent is extended or adjusted under 35 U.S.C. 154(b) by 212 days.

(21) Appl. No.: 13/916,097

(22) Filed: Jun. 12, 2013

(65) Prior Publication Data

US 2014/0370727 A1 Dec. 18, 2014

(51) Int. Cl.

| | |
|---|---|
| ***H01R 4/58*** | (2006.01) |
| ***H01R 13/24*** | (2006.01) |
| ***H01R 43/20*** | (2006.01) |
| ***H01R 12/71*** | (2011.01) |

(52) U.S. Cl.

CPC ..... *H01R 13/2414* (2013.01); *H01R 12/718* (2013.01); *H01R 43/205* (2013.01); *Y10T 29/49147* (2015.01)

(58) Field of Classification Search

CPC .... H01R 13/6215; H01R 13/24; H01R 13/22; H01R 13/2414; H01R 43/0207; H01R 43/205; H01L 23/4006; Y10T 29/49147

USPC ..... 439/86

See application file for complete search history.

(56) References Cited

U.S. PATENT DOCUMENTS

| | | | |
|---|---|---|---|
| 2,578,288 | A | 12/1951 | Cook |
| 2,951,817 | A | 9/1960 | Myers |
| 3,229,756 | A | 1/1966 | Keresztury |
| 3,728,509 | A | 4/1973 | Shimojo |
| 3,760,342 | A | 9/1973 | Prouty et al. |

(Continued)

FOREIGN PATENT DOCUMENTS

| | | |
|---|---|---|
| EP | 0 905 826 A2 | 3/1999 |
| WO | WO 97/16849 | 5/1997 |
| WO | WO 99/66599 | 12/1999 |

OTHER PUBLICATIONS

Application Notes for Surface Mount Assembly of Amkor's MicroLeadFrame(MLF) Packages. Sep. 2002.

(Continued)

*Primary Examiner* — Jean F Duverne

(74) *Attorney, Agent, or Firm* — Mueting, Raasch & Gebhardt, P.A.

(57) ABSTRACT

An adapter apparatus for receiving a packaged device having a plurality of contact elements disposed on a surface thereof may include a conductive elastomer interconnect. The conductive elastomer interconnect may include a carrier having a plurality of openings defined therethrough from a first side to a second side thereof (e.g., the plurality of openings being arranged to align with the plurality of contact elements of the packaged device) and conductive elastomer suspended in each of the plurality of openings to contact a contact element of a plurality of contact elements of a packaged device when positioned adjacent the second side of the carrier. Further, the adapter apparatus may include one or more adapter wall members used with the conductive elastomer interconnect to define a socket cavity adapted to receive the packaged device.

20 Claims, 8 Drawing Sheets

(56) References Cited

U.S. PATENT DOCUMENTS

| | | | | |
|---|---|---|---|---|
| 3,870,385 | A | | 3/1975 | Avakian et al. |
| 3,971,610 | A | | 7/1976 | Buchoff et al. |
| 4,295,699 | A | | 10/1981 | DuRocher |
| 4,345,810 | A | | 8/1982 | Bakermans |
| 4,460,223 | A | | 7/1984 | Brown et al. |
| 4,514,784 | A | | 4/1985 | Williams et al. |
| 4,550,959 | A | | 11/1985 | Grabbe et al. |
| 4,655,524 | A | | 4/1987 | Etzel |
| 4,668,957 | A | | 5/1987 | Spohr |
| 4,678,250 | A | | 7/1987 | Romine et al. |
| 4,729,166 | A | | 3/1988 | Lee et al. |
| 4,754,546 | A | | 7/1988 | Lee et al. |
| 4,762,498 | A | | 8/1988 | Harting et al. |
| 4,862,076 | A | | 8/1989 | Renner et al. |
| 4,878,861 | A | | 11/1989 | Kendall et al. |
| 4,923,739 | A | | 5/1990 | Jin et al. |
| 5,074,799 | A | | 12/1991 | Rowlette, Sr. |
| 5,109,320 | A | | 4/1992 | Bourdelaise et al. |
| 5,123,849 | A | | 6/1992 | Deak et al. |
| 5,127,837 | A | * | 7/1992 | Shah et al. ..... 439/71 |
| 5,129,833 | A | | 7/1992 | Rowlette, Sr. |
| 5,137,462 | A | | 8/1992 | Casey et al. |
| 5,140,405 | A | | 8/1992 | King et al. |
| 5,155,661 | A | | 10/1992 | Nagesh et al. |
| 5,163,837 | A | | 11/1992 | Rowlette, Sr. |
| 5,286,218 | A | | 2/1994 | Sakurai et al. |
| 5,313,099 | A | | 5/1994 | Tata et al. |
| 5,318,456 | A | | 6/1994 | Mori |
| 5,340,318 | A | | 8/1994 | Kunihiro |
| 5,377,900 | A | | 1/1995 | Bergmann |
| 5,387,861 | A | | 2/1995 | Neiderhofer |
| 5,389,819 | A | | 2/1995 | Matsuoka |
| 5,397,240 | A | | 3/1995 | Herard |
| 5,397,245 | A | | 3/1995 | Roebuck et al. |
| 5,397,919 | A | | 3/1995 | Tata et al. |
| 5,418,471 | A | | 5/1995 | Kardos |
| 5,432,679 | A | | 7/1995 | Grabbe |
| 5,445,526 | A | | 8/1995 | Hoshino et al. |
| 5,468,158 | A | | 11/1995 | Roebuck et al. |
| 5,473,510 | A | | 12/1995 | Dozier, II |
| 5,477,160 | A | | 12/1995 | Love |
| 5,528,462 | A | | 6/1996 | Pendse |
| 5,548,223 | A | | 8/1996 | Cole et al. |
| 5,566,052 | A | | 10/1996 | Hughes |
| 5,636,996 | A | | 6/1997 | Johnson et al. |
| 5,662,163 | A | | 9/1997 | Mira |
| 5,667,870 | A | | 9/1997 | McCullough |
| 5,691,041 | A | | 11/1997 | Frankeny et al. |
| 5,699,227 | A | | 12/1997 | Kolman et al. |
| 5,710,459 | A | | 1/1998 | Teng et al. |
| 5,712,768 | A | | 1/1998 | Werther |
| 5,730,620 | A | | 3/1998 | Chan et al. |
| 5,735,698 | A | | 4/1998 | Bakker et al. |
| 5,741,141 | A | | 4/1998 | O'Malley |
| 5,742,481 | A | | 4/1998 | Murphy et al. |
| 5,745,346 | A | | 4/1998 | Ogawa et al. |
| 5,761,050 | A | | 6/1998 | Archer |
| 5,766,022 | A | | 6/1998 | Chapin et al. |
| 5,770,891 | A | | 6/1998 | Frankeny et al. |
| 5,783,461 | A | | 7/1998 | Hembree |
| 5,791,914 | A | | 8/1998 | Loranger et al. |
| 5,793,618 | A | | 8/1998 | Chan et al. |
| 5,805,424 | A | | 9/1998 | Purinton |
| 5,810,607 | A | * | 9/1998 | Shih et al. ..... 439/66 |
| 5,819,406 | A | | 10/1998 | Yoshizawa et al. |
| 5,829,988 | A | | 11/1998 | McMillan et al. |
| 5,833,471 | A | | 11/1998 | Selna |
| 5,859,538 | A | | 1/1999 | Self |
| 5,876,219 | A | | 3/1999 | Taylor et al. |
| 5,877,554 | A | | 3/1999 | Murphy |
| 5,879,172 | A | | 3/1999 | McKenna-Olson et al. |
| 5,892,245 | A | | 4/1999 | Hilton |
| 5,893,765 | A | | 4/1999 | Farnworth |
| 5,896,037 | A | | 4/1999 | Kudla et al. |
| 5,923,176 | A | | 7/1999 | Porter et al. |
| 5,973,618 | A | | 10/1999 | Ellis |
| 5,982,635 | A | | 11/1999 | Menzies et al. |
| 6,007,348 | A | | 12/1999 | Murphy |
| 6,325,280 | B1 | | 12/2001 | Murphy |
| 6,351,392 | B1 | | 2/2002 | Palaniappa et al. |
| 6,394,820 | B1 | | 5/2002 | Palaniappa et al. |
| 6,533,589 | B1 | | 3/2003 | Palaniappa et al. |
| 6,623,280 | B2 | | 9/2003 | Oldenburg et al. |
| 6,644,981 | B2 | | 11/2003 | Choy |
| 6,877,993 | B2 | | 4/2005 | Palaniappa et al. |
| 7,083,434 | B1 | | 8/2006 | Blossfeld |
| 7,368,814 | B1 | | 5/2008 | Tully et al. |
| 7,874,880 | B2 | | 1/2011 | Fedde et al. |
| 8,091,222 | B2 | | 1/2012 | Fedde et al. |

OTHER PUBLICATIONS

Ironwood Electronics, Inc. VLSI Interconnection Specialists Catalog XII (pp. 84, 110) (product on p. 110 available at least as early as Oct. 4, 1998).

Ironwood Electronics, Inc. VLI Interconnection Specialists Product Brochure, Spring 1998. 6 pages.

Herard et al., "Interconnection Technology: Using dendrites to bridge the gaps," *Printed Circuit Fabrication*, 1995;18(9):22-24.

Jarvela R.A., "Module Holder and Actuator," *Technical Disclosure Bulletin*, 1974;16(12):3975-3976.

Lau, John H. ed., "A brief introduction to Ball Grid Array Technologies," *ball Grid Array Technology*, 1995;pp. xii-i-xvi:1-57.

* cited by examiner

ADAPTER APPARATUS WITH SUSPENDED CONDUCTIVE ELASTOMER INTERCONNECT

BACKGROUND

The present disclosure relates generally to electrical adapters and methods related to such adapters. More particularly, the present disclosure pertains to adapters for packaged integrated circuit devices, e.g., ball grid array packages.

Certain types of integrated circuit packages are becoming increasingly popular due to their occupancy area efficiency. In other words, they occupy less area on a target board on which they are mounted while providing a high density of contact terminals. For example, one such high density package type is a ball grid array package (e.g., a micro ball grid array package). Generally, such packages contain an integrated circuit having its die bond pads electrically connected to respective conductive contact elements (e.g., spheres/balls) that are distributed on a surface of the package (e.g., the bottom surface of the package, for example, in an array).

A target printed circuit board upon which the package is to be mounted typically has formed on its surface a corresponding array of conductive pads which are aligned with the conductive contact elements of the packaged device for electrically mounting the package on the target board. The target board typically includes other conductive traces and elements which lead from the array of conductive pads used for mounting the package to other circuitry on the board for connecting various components mounted thereon. To mount such a package to a target board, for example, the package may be positioned with the contact elements thereof adjacent to the corresponding array of conductive pads on the target board and, for example, the resulting structure may be heated until solder melts and fuses the contact elements of the package to the conductive pads of the target board.

Such area efficient packaging, e.g., micro ball grid array packages, provides a high density of terminals at a very low cost. Also, this packaging provides for limited lead lengths (e.g., short leads). The limited lead lengths may reduce the risk of damage to such leads of the package, may provide for higher speed product, etc.

Generally, circuit boards and/or components mounted thereon are tested by designers as the circuit boards are being developed. For example, for a designer to test a circuit board and/or a package mounted thereon, the designer must first electrically connect the package to the target circuit board.

As described herein, this may include mounting the package on the target board and heating to fuse the contact elements of the package to the conductive pads of the target board. Therefore, the package may be prevented from being used again. It is desirable for various reasons to use package adapters for mounting the packages and reuse such packages after testing. For example, such device packages may be relatively expensive. Further, for example, once attached, the contacts may not be accessible for testing. In addition, it is often difficult to rework the circuit board with the packages soldered thereon.

Various adapters are available to electrically connect a package to a target printed circuit board without requiring that the contact elements on the package be fused to the target board. However, the high density of terminals for certain packages, e.g., micro ball grid array packages, leads to various interconnect problems for adapters being used with such packages. For example, alignment of the contact elements of the packaged device to the contact pads of the target board may be problematic when an electrical adapter is used. Further, providing effective contact with minimal adaptive structure may be difficult. Various adapters have been described for electrically connecting high density packaged devices to a target printed circuit board, such as, for example, U.S. Pat. No. 6,877,993 to Palaniappa et al., issued 12 Apr. 2005, entitled "Packaged Device Adapter Assembly with Alignment Structure and Methods Regarding Same," and U.S. Pat. No. 6,394,820 to Palaniappa et al., issued 28 May 2002, entitled "Packaged Device Adapter Assembly and Mounting Apparatus," describe adapter apparatus that use a conductive elastomer layer to provide electrical contact.

SUMMARY

The disclosure herein provides packaged device adapter assemblies useable for high density integrated circuit packages, e.g., micro ball grid array packages, etc.

One exemplary adapter apparatus disclosed herein for receiving a packaged device having a plurality of contact elements disposed on a surface thereof may include a conductive elastomer interconnect. The conductive elastomer interconnect may include a carrier having a plurality of openings defined therethrough from a first side to a second side thereof (e.g., the plurality of openings may be arranged to align with the plurality of contact elements of the packaged device) and conductive elastomer suspended in each of the plurality of openings to contact a contact element of a plurality of contact elements of a packaged device when positioned adjacent the second side of the carrier. Further, the adapter apparatus may include one or more adapter wall members along an adapter axis between a first end region of the adapter apparatus and a second end region of the adapter apparatus. The conductive elastomer interconnect may be positioned at the first end region of the adapter apparatus orthogonal to the adapter axis and the one or more adapter wall members and the conductive elastomer interconnect may define a socket cavity adapted to receive the packaged device with the plurality of contact elements thereof adjacent the conductive elastomer suspended in each of the plurality of openings.

Another exemplary adapter apparatus for use in an adapter configured to receive a packaged device having a plurality of contact elements disposed on a surface thereof may include a conductive elastomer interconnect that includes a carrier having a plurality of openings defined therethrough from a first side to a second side thereof (e.g., the plurality of openings are arranged to align with the plurality of contact elements of the packaged device) and conductive elastomer suspended in each of the plurality of openings to contact a contact element of a plurality of contact elements of a packaged device when positioned adjacent the second side of the carrier.

One or more embodiments of such adapter apparatus may include one or more of the following features: the first and second sides of the carrier may be free of conductive elastomer; the packaged device may include a ball grid array having a plurality of balls; each opening of the plurality of openings defined through the carrier may be a cylindrical opening having a diameter sized to receive a ball of the plurality of balls of the ball grid array; the conductive elastomer suspended in each of the plurality of openings may include a curable conductive elastomer material (e.g., a curable conductive elastomer material that includes a plurality of conductive particles); the conductive elastomer suspended in each of the plurality of openings may include a concave surface at the second side of the carrier for electrical contact with the contact elements of the packaged device; the conductive elastomer suspended in each of the plurality of openings may include a contact projection extending beyond the first side of the carrier for electrical contact with a contact pad of a plurality of contact pads of a target board when the target board is positioned adjacent the first side of the carrier; the one or more wall members may include alignment structure positioned at the first end region to align the packaged device within the socket cavity (e.g., the alignment structure may include at least an alignment plate positioned orthogonal to the adapter axis; the alignment plate may include a plurality of openings arranged to align with the plurality of contact elements of the packaged device and adapted to allow contact elements of the packaged device to be in electrical contact with the conductive elastomer suspended in each of the plurality of openings defined in the carrier layer, etc.); and an actuator apparatus including a floating member movable in the socket cavity and an actuator element (e.g., the actuator element may be operable to provide a force on the floating member resulting in a corresponding force being distributed to the packaged device when received in the socket cavity such that the plurality of contact elements are in electrical contact with the suspended conductive elastomer in each of the plurality of openings defined in the carrier, the suspended conductive elastomer in each of the plurality of openings defined in the carrier may be flexed towards the first side of the carrier when the force is applied, etc.).

One exemplary embodiment of a method of providing an adapter apparatus adapted to receive a packaged device having a plurality of contact elements disposed on a surface thereof (e.g., the adapter apparatus mountable to a target board to electrically connect the plurality of contact elements to a plurality of contact pads of the target board) may include providing a conductive elastomer interconnect such as described herein including, for example, a carrier and conductive elastomer suspended in each of a plurality of openings defined therethrough. The method may further include providing one or more adapter wall members along an adapter axis between a first end region and a second end region of the adapter apparatus and positioning the conductive elastomer interconnect at the first end region of the adapter apparatus orthogonal to the adapter axis to define a socket cavity of the adapter apparatus adapted to receive a packaged device such that the plurality of contact elements of the packaged device are adjacent the conductive elastomer suspended in each of the plurality of openings.

In one embodiment of the exemplary method, providing a conductive elastomer interconnect may include positioning the first side of the carrier adjacent a formation surface to close the plurality of openings defined through the carrier, providing conductive elastomer at least within the plurality of openings defined through the carrier, and curing the conductive elastomer within the plurality of openings to provide the suspended conductive elastomer in each of the plurality of openings. For example, the formation surface may be a planar surface or a nonplanar surface (e.g., a formation surface having at least one surface deformation defined therein corresponding to each of the plurality of openings defined through the carrier, wherein the at least one surface deformation forms a contact projection of the suspended conductive elastomer extending beyond the first side of the carrier for electrical contact with a contact pad of a plurality of contact pads of a target board when the target board is positioned adjacent the first side of the carrier).

In another embodiment of the exemplary method, the method may further include providing an actuator apparatus that includes a floating member movable in the socket cavity and an actuator element (e.g., the actuator element may be operable to provide a force on the floating member such that a corresponding force is distributed to a packaged device when received in the socket cavity) and providing electrical contact between the plurality of contact elements of the packaged device and the suspended conductive elastomer in each of the plurality of openings defined in the carrier via the force provided on the floating member (e.g., the suspended conductive elastomer in each of the plurality of openings defined in the carrier may be flexed towards the first side of the carrier when the force is applied).

The above summary of the present disclosure is not intended to describe each embodiment or every implementation thereof. Advantages, together with a more complete understanding of the disclosure, will become apparent and appreciated by referring to the following detailed description and claims taken in conjunction with the accompanying drawings.

DETAILED DESCRIPTION OF EXEMPLARY EMBODIMENTS

Figure 1:
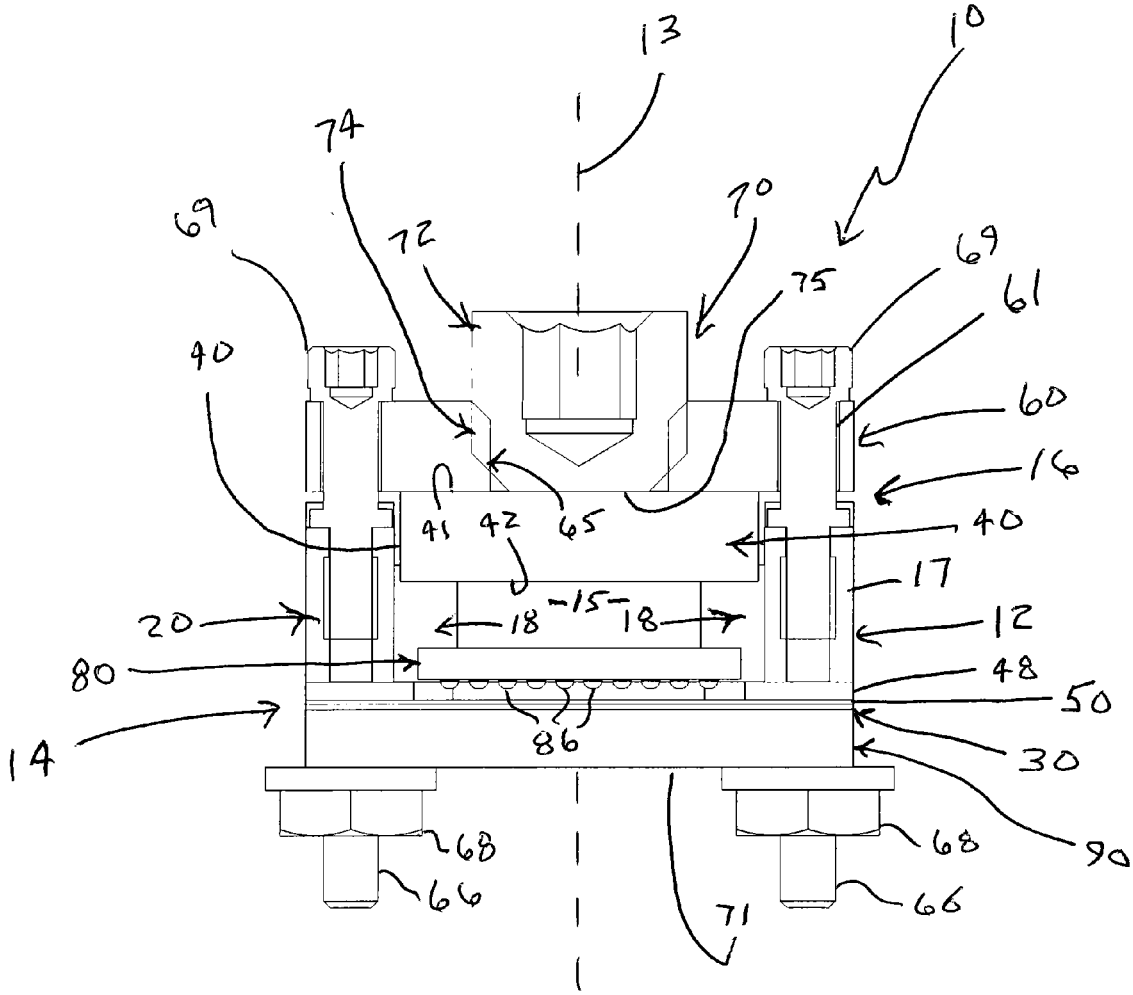
FIG. 1 is a cross-sectional side view of an exemplary packaged device adapter assembly mounted on a target board.

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Generally, packaged device adapter assemblies for use with packaged devices, e.g., high density devices, such as ball grid array packages, along with methods of using and forming such assemblies or portions thereof, shall be described herein. An illustrative packaged device adapter assembly 10 according to the present invention shall be described with reference to illustrative FIGS. 1-3. Other features and or illustrations relating to packaged device adapter assemblies, including methods of forming such features, shall be described with reference to FIGS. 4-5.

In other words, exemplary adapter apparatus and methods for providing and using such adapters shall generally be described with reference to FIGS. 1-5. It will be apparent to one skilled in the art that elements from one embodiment may be used in combination with elements of the other embodiments, and that the possible adapter apparatus embodiments using features set forth herein is not limited to the specific embodiments described (e.g., various illustrative embodiments described may include some features or elements included in other illustrative embodiments and/or exclude other features). For example, as will be readily apparent from the description herein, various types of alignment structure, wall members used to form socket cavities, actuator structure, covers, etc., may be used in combination with each of the various embodiments of adapter assemblies described herein, and further other adapter assemblies may benefit from features described herein (e.g., adapter assemblies that may not be described herein). Further, it will be recognized that the embodiments described herein may include many elements that are not necessarily shown to scale. Further, it will be recognized that the size and shape of various elements herein may be modified without departing from the scope of the present disclosure, although one or more shapes and sizes may be advantageous over others.

Figure 2A:
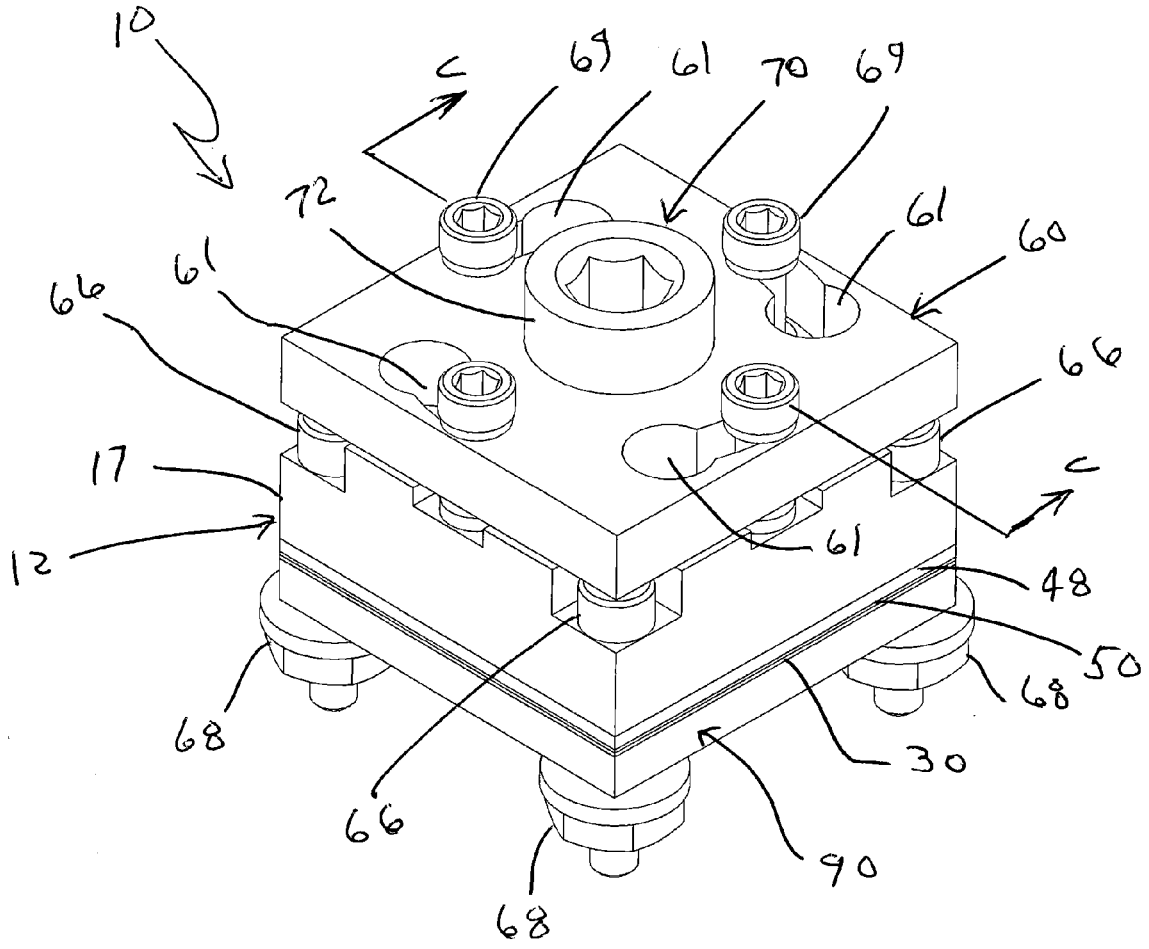
FIG. 2A is a perspective view of a packaged device adapter assembly including features shown in FIG. 1.
Figure 2B:
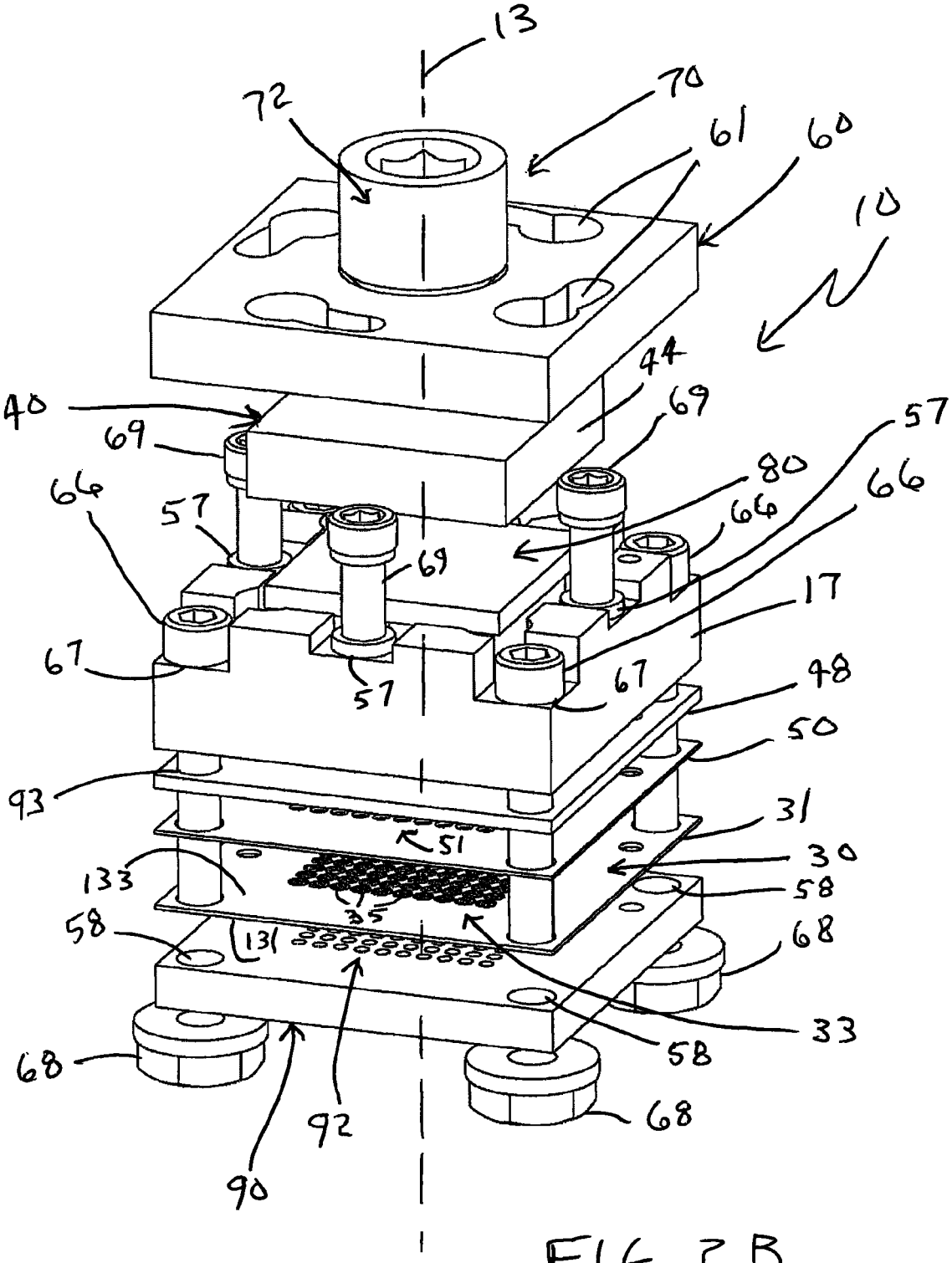
FIG. 2B is a top exploded perspective view of the packaged device adapter assembly of FIG. 2A.
Figure 2C:
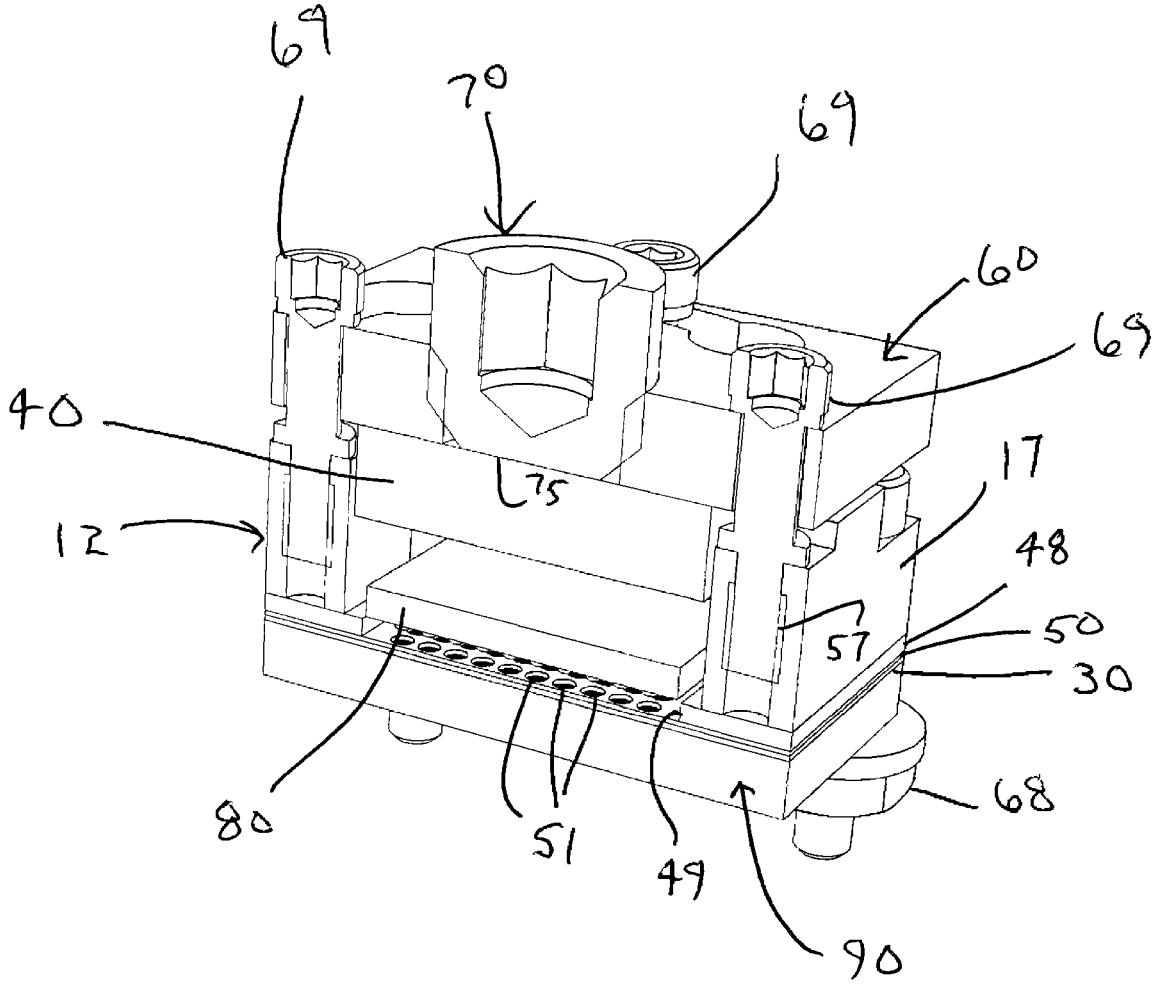
FIG. 2C is a cross-section of the packaged device adapter assembly of FIG. 2A taken along line CC.

FIGS. 1-3 show a cross-section side view and various other views, including an exploded perspective view in FIG. 2B, of an illustrative and exemplary packaged device adapter assembly 10 for use with a packaged device 80 according to the present invention. Generally, the packaged device adapter assembly 10 is for mounting on a target board 90. The packaged device adapter assembly 10 includes one or more wall members 12 (e.g., perimeter wall members, base socket member 17, etc.) having a length along an adapter axis 13. Generally, the length of the one or more wall members 12 extends between a first end region 14 of the packaged device adapter assembly 10 and a second end region 16 of the packaged device adapter assembly 10. The one or more wall members 12 may include an inner surface region 18 facing towards the adapter axis 13 (e.g., used to form socket cavity 15) and an opposing outer surface region 20 facing away from the adapter axis 13.

The packaged device adapter assembly 10 further includes a conductive elastomer interconnect 30. In at least one embodiment, the conductive elastomer interconnect 30 includes a carrier 31 including a plurality of openings 33 defined therethrough from a first side 131 to a second side 133 thereof. The plurality of openings 33 are arranged to align with a plurality of contact elements 86 of the packaged device 80. In one or more embodiments, conductive elastomer 35 may be suspended in each of the plurality of openings 33 to contact a contact element of the plurality of contact elements 86 of the packaged device 80 when the packaged device 80 is positioned adjacent the second side 133 of the carrier 31.

The one or more wall members 12 (e.g., various structure along the adapter axis 13 between the first end region 14 and second end region 16 of the adapter assembly 10) and the conductive elastomer interconnect 30 (e.g., positioned at the first end region 14 of the adapter assembly 10 orthogonal to the adapter axis 13) may define a socket cavity 15 sized or otherwise configured to receive the packaged device 80. The socket cavity 15 is adapted to receive the packaged device 80 with each contact element of the plurality of contact elements 86 adjacent a corresponding conductive elastomer 35 suspended in an opening of the plurality of openings 33.

Figure 2D:
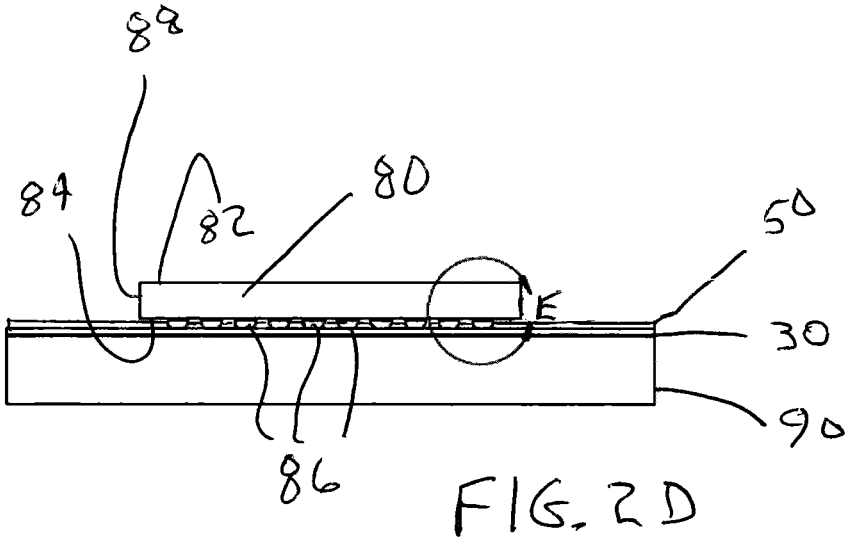
FIG. 2D is a side view of a portion of the packaged device adapter assembly showing a compressed state.
Figure 2E:
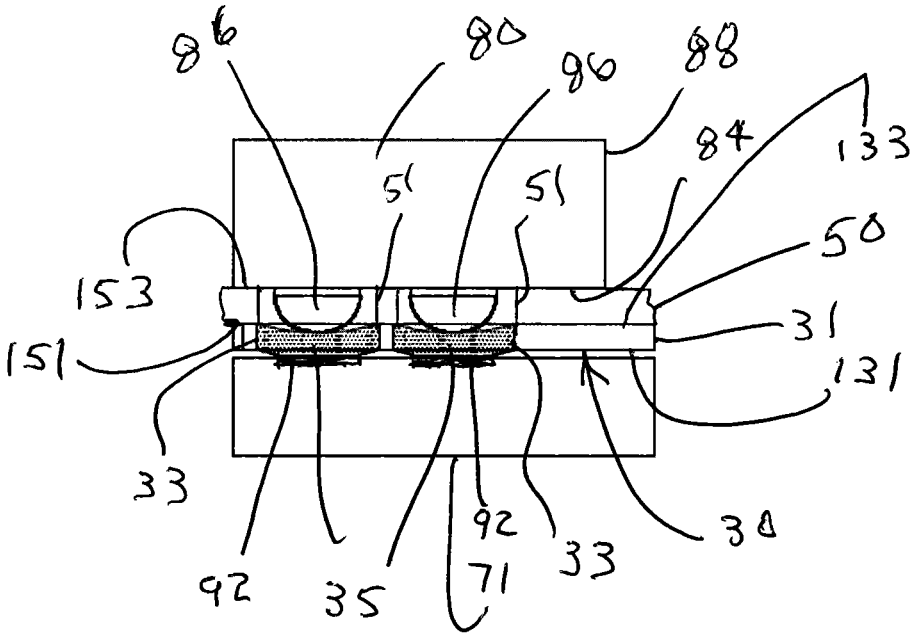
FIG. 2E is a more detail view of a portion of FIG. 2D.

In one or more embodiments, for example, as shown in FIGS. 2D-2E, the packaged device 80 may include an upper surface 82 and a lower surface 84 in addition to one or more side surfaces 88 extending therebetween at the perimeter of the packaged device 80. A plurality of contact elements 86 (e.g., balls/spheres of a ball grid array) may be disposed at least at the lower surface 84. For example, the contact elements 86 may be distributed in an array along x and y axes orthogonal to the adapter axis 13 or the contact elements (e.g., spheres or balls, etc.) may be distributed along the outer portions of the lower surface 84 proximate the perimeter thereof. However, any arrangement of contact elements 86 may be accommodated according to the present disclosure.

The packaged device 80 may be any packaged device having a plurality of contact elements 86 disposed on a surface thereof suitable for electrical connection with conductive elastomer 35 suspended within the plurality of openings 33 of the conductive elastomer interconnect 30. In one or more embodiments, the packaged device may be a device having a high density of contact terminals, e.g., lands, solder spheres, bumps, contact pads, leads, etc., disposed on a surface thereof. For example, the high density packaged device may be a micro lead frame package, a micro lead chip carrier, a quad flat no lead package, a micro ball grid array package, or any other type of package such as a ball grid array package, a chip scale package, a flip chip package, a flat package, a quad flat package, a small outline package, a land grid array package, or any other package having contact elements disposed on a surface thereof suitable for electrical connection with conductive elastomer 35 suspended within the plurality of openings 33 of the conductive elastomer interconnect 30.

In at least one embodiment, the packaged device 80 includes a ball grid array package device having contact elements 86 in the form of spheres or balls on the lower surface 84. However, adapter assemblies and adapter concepts described herein may be used with any other packaged device having contact elements disposed on a surface thereof which would benefit from the use of the conductive elastomer interconnect 30. Further, any number of different sizes and/or configurations of packaged devices may benefit from features described herein (e.g., packaged devices with only one planar surface having contact elements disposed thereon, packaged devices having upper and lower surfaces that are parallel to one another, packaged devices having upper and lower surfaces that are not parallel to one another, etc.).

Further, the packaged device adapter assembly 10 may include a cover member 60 positioned at the second end 16 of the one or more wall members 12 (e.g., adjacent the socket base member 17 along axis 13) to close the socket cavity 15. The cover member 60 may be movable, e.g., removable via fastening devices 69 as shown in FIGS. 1-2. However, the cover member may also be moveable about a hinge axis (not shown), or any other manner of removing or moving the cover to open the socket cavity for allowing a packaged device to be received therein. In other words, one or more cover member configurations may allow the packaged device 80 to be removed from the socket cavity 15 and another packaged device placed therein. The packaged device adapter assembly 10 is generally used to provide electrical contact between the contact elements 86 of the packaged device 80 and contact pads 92 of the target board 90 via the conductive elastomer interconnect 30 when the packaged device 80 is positioned in the socket cavity 15.

The one or more wall members 12 may include any number of different structures (e.g., along the adapter axis 13) between the first end region 14 and second end region 16 of the adapter assembly 10. For example, the one or more wall members 12 may include a socket base member 17 extending from a first end located towards the first end region 14 of the adapter assembly 10 to a second end location towards the second end region 16. For example, in one or more embodiments, such a socket base member 17 may define an opening therethrough along axis 13 (e.g., providing, at least in part, the inner surface region 18 of adapter assembly 10) to form at least a part of the defined socket cavity 15 sized or otherwise configured to receive the packaged device 80.

Further, for example, the one or more wall members 12 may include one or more types of alignment structure positioned at the first end region 14 (e.g., adjacent the first end of socket base member 17) to align the packaged device 80 within the socket cavity 15. For example, in one or more embodiments, the alignment structure may include an alignment plate 48 positioned orthogonal to the adapter axis 13. For example, the alignment plate 48 may define an opening therethrough along axis 13 (e.g., providing, at least in part, the inner surface region 18 of adapter assembly 10) to form at least a part of the defined socket cavity 15 sized or otherwise configured to receive the packaged device 80. For example, the alignment plate 48 may include an inner surface 49 defining the opening along axis 13 (e.g., the opening being sized to align the packaged device 80 within the socket cavity 15 for effective electrical contact of the plurality of contact elements 86 of the packaged device 80 and the conductive elastomer 35 suspended in each of the plurality of openings 33; each opening 33 of the conductive elastomer interconnect 30 corresponding to a particular contact element 86). Such alignment structure may be of any configuration suitable to provide alignment within the socket cavity 15. For example, alignment structure may include a single surface defining an opening to provide the alignment function or may be as described in U.S. Pat. No. 6,877,993 B2 to Palaniappa et al., issued 12 Apr. 2005, and entitled "Packaged Device Adapter Assembly Alignment Structures and Methods Regarding Same."

One will recognize that the one or more wall members 12 may use any number of structures to provide an opening into which the packaged device 80 is received. Such structures may take any shape and/or form suitable to provide a socket cavity for receiving the packaged device 80 and the present disclosure is not limited to any particular configuration of such one or more wall members 12 (e.g., not limited to any number and/or shape described herein).

The packaged device adapter assembly 10 further includes actuator apparatus, such as, for example, a floating member 40 (e.g., a compression plate for providing a force on the packaged device 80) as shown in FIGS. 1-2. The floating member 40 may be used in combination with other actuator apparatus, including, for example, an actuator element 70, to provide a distributed force on the packaged device 80 when received in the socket cavity 15 such that the contact elements 86 disposed on the lower surface 84 of the packaged device 80 are in effective electrical contact with the conductive elastomer 35 suspended in the openings 33 of the conductive elastomer interconnect 30. In FIG. 1, the floating member 40 is shown spaced apart from the packaged device 80, as is the conductive elastomer interconnect 30.

At least in one embodiment, the floating member 40 includes an upper surface 41 that is generally planar and orthogonal to the adapter axis 13 when the floating member 40 is positioned in the socket cavity 15. Further, at least in one embodiment, the floating member 40 includes a lower surface 42 that is configured as a function of the upper surface 82 of the packaged device 80. For example, as shown in FIG. 1, lower surface 42 of the floating member 40 is generally planar for direct contact with the planar upper surface 82 of a packaged device 80. However, the lower surface of the floating member 40 may be configured in any manner and need not be planar. Further, the floating member may be formed of any number of different components. However, in at least one embodiment, at least a portion of the lower surface 42 of the floating member 40 is in direct contact with the upper surface 82 of the packaged device 80. The floating member 40 as shown in FIGS. 1-2 includes an edge surface 44 extending between the upper surface 41 and the lower surface 42 at the perimeter of the floating member 40. The edge surface 44 lies adjacent, and may even be in contact with, the inner surface region 18 defined, for example, by the one or more wall members 12, and is moveable relative thereto within the socket cavity 15.

The actuator element 70 may be any actuator element operable to apply a force on the upper surface 41 of the floating member 40. As a force is applied by the actuator element 70 to the upper surface 41 of the floating member 40, the force is distributed generally equally along the upper surface 82 of the packaged device 80. As such, an equivalent force is provided at each contact element 86, e.g., ball or sphere, for effective contact between each contact element 86 and the suspended conductive elastomer 35 within a corresponding opening of the plurality of openings 33 defined in carrier 31 of the conductive elastomer interconnect 30. Such a distributed force across the entire packaged device 80 reduces the potential application of excessive force on one part of the packaged device 80 versus another part thereof, e.g., the center versus the perimeter.

Generally, in one or more embodiments, the actuator element 70 is an element associated with the cover member 60. For example, the actuator element may be a spring element, a leaf spring, or any other flexible element capable of applying a force to the floating member 40 via the association with the cover member 60. Further, the cover member 60 itself may be used to apply a force to the floating member 40 such as by tightening the cover member directly down on the floating member 40 by fastening elements, e.g., screws.

At least in one embodiment as shown in FIG. 1, the actuator element 70 may be a threaded element that includes an upper region 72 with a threaded portion 74 extending therefrom. Further, in such an embodiment, the cover member 60 includes a threaded insert 65 positionable along the axis 13 of the adapter assembly 10 for mating with the threaded portion 74 of the actuator element 70. The threaded portion 74 may terminate in a generally planer surface 75.

With the packaged device 80 in the socket cavity 15, the planer surface 75 is placed in direct contact with the upper surface 41 of the floating member 40 by turning the actuator element 70. As such, the actuator element 70 is adjustable to provide an effective force to the upper surface 41 of floating member 40 such that the distributed force is applied for effective electrical coupling of the contact elements 86 to the suspended conductive elastomer 35 of conductive elastomer interconnect layer 30. With use of the actuator element 70 and the floating member 40, a suitable distributed force on the packaged device 80 can be achieved. The minimized load applied to the packaged device 80 and thus to the conductive elastomer 35 suspended in the openings 33 of the conductive elastomer interconnect 30 allows for operation of the adapter assembly 10 over many insertion cycles as the conductive elastomer interconnect 30 is not unnecessarily damaged by the force applied to the packaged device 80 to achieve contact between all of the contact elements 86 and suspended conductive elastomer 35.

In one or more embodiments, the floating member 40 may be formed of a heat conductive material, e.g., aluminum, to provide heat sinking capability. Further, actuator element 70 and the one or more wall members 12 and cover 60 may be formed of such heat sinking material. In such a manner, the elements that form the socket cavity 15 which provide electrical coupling of the packaged device 80 to a target board 90 also function to dissipate heat away from the packaged device 80 when the packaged device 80 is operable. This is particularly beneficial for high density packaged devices in that such packaged devices tend to operate with greater heat output.

As can be seen from FIG. 1, the floating member 40 may be sized and configured such that edge 44 thereof is in moveable contact with inner surface region 18 provided, at least in part, by the one or more wall members 12 which allows heat conduction therethrough and away from the packaged device 80. Likewise, the contact between the actuator element 70 and the floating member 40, such as provided by a screw formed of aluminum, may allow for heat conduction from the threaded portion 74 (which is in direct contact with the floating member 40) to the exterior of the socket cavity 15.

It will be recognized that various elements or portions of the adapter assembly 10 may be formed of multiple layers or components or as single piece elements. For example, it will be recognized that the one or more wall members 12 may include multiple pieces or it may be formed as a single piece element. Further, for example, the floating member 40 may be formed of one or more layers or components.

The adapter assemblies as described herein may be mounted relative to various target boards as illustrated generally in FIG. 1 by target board 90 and may be mounted to the target board 90 in any number of different manners, many of which would be readily known by one skilled in the art. For example, such mounting may be performed as described in U.S. Pat. No. 6,394,820 issued 28 May 2002, entitled "Packaged Device Adapter Assembly and Mounting Apparatus," which is incorporated herein by reference.

The target board 90 may be any substrate including contact pads or other conductive elements arranged thereon for electrical connection with the adapter assembly 10. For example, the target board may be a printed circuit board including various other components mounted thereon or may be a surface mountable substrate (e.g., an interconnect board that may be used with printed circuit boards that do not have mounting holes therein or when it is undesirable to provide mounting holes in the target board 90).

As shown in FIG. 1, the adapter assembly 10 may be mounted relative to target board 90 (e.g., a printed circuit board) in a manner using fastening devices (e.g., a threaded bolt 66 and washer/nut 68). Target board 90 includes openings 58 defined therein for use in attachment of the adapter assembly 10 to the target board 90 using the fastening devices. The threaded bolts 66 extend through openings 67, 93 defined in the one or more wall members 12 (e.g., such as socket base 17, alignment plate 48, etc.) and which further extend through openings 58 and beyond the lower surface 71 of the target board 90. A mating device, e.g., washer/nut 68, may then be coupled to the threaded bolts 66 which can be tightened to hold the assembly 10 in position relative to the target board 90.

It will be recognized that the adapter assemblies as described herein may be mounted relative to various configurations of target boards, including but clearly not limited to those described herein (e.g., a surface mountable board, a printed circuit board, etc.). Further, such mounting of the adapter assemblies relative to such target boards may be accomplished in any manner, including but clearly not limited to those described herein (e.g., adhesive, fastening devices including bolts and nuts, threaded inserts, etc.).

The adapter assembly 10, as shown in FIGS. 1-2, is formed in a substantially square configuration. However, one skilled in the art will recognize that the elements used in forming the packaged device adapter assembly 10 may include elements for forming an adapter assembly configured as a rectangle, a circle, or any other configuration sized to accommodate a packaged device received in a socket cavity therein. As such, one skilled in the art will recognize that the present disclosure is not limited to any particular shape of adapter assembly, but is limited only as described in the appended claims.

As described herein, the cover member 60 of the packaged device adapter assembly 10 may be configured in various manners. The cover member 60 is used to close the socket cavity 15 and may include various other elements associated therewith for facilitating other functionality. For example, as previously described herein, in one embodiment as shown in FIG. 1, cover member 60 may be integrated with threaded insert 65 for receiving the threaded portion 74 of the actuator element 70 (e.g., a compression screw) used in applying a direct force to floating member 40 (e.g., a compression plate). Further, cover member 60 as shown in FIG. 1 may include openings 61 for receiving corresponding fastening elements 69, e.g., screws or threaded bolts, to affix cover member 60 to the one or more wall members 12 (e.g., socket base member 17). In such an embodiment, the one or more wall members 12 may include inserts 57 for receiving the fastening elements 69 therein. For example, as shown in FIG. 1, inserts 57 may be threaded inserts for retaining threaded screw portions of screws 69 to attach cover member 60 to the socket base member 17.

However, in another embodiment, the cover member 60 may also be configured as a latchable hinge cover as shown and described in U.S. Pat. No. 6,394,820, e.g., a ZIF type or clam-type lid. Although several cover members are described herein, the present invention is not limited to only such configurations as various other configurations may provide suitable closure function for the adapter.

Further, with reference to FIGS. 1-2, and also with reference to FIGS. 3A-3D, the conductive elastomer interconnect 30 includes the carrier 31 through which a plurality of openings 33 are defined from the first side 131 to the second side 133 thereof. The carrier 31, at least in one embodiment, includes parallel first and second sides 131, 133 and has a thickness in the range of about 0.004 inches to about 0.010 inches. Further, for example, the thickness may be greater than about 0.002 inches or less than about 0.012 inches. By providing such a short contact between the target board contact pads 92 and the contact elements 86 of the packaged device 80 (e.g., the short contact being the thin layer of suspended conductive elastomer in the opening defined in the thin carrier layer), the adapter assembly 10 may be effective for high bandwidth applications.

Further, the carrier 31 may be formed of one or more layers and/or portions of any suitable material. For example, the carrier may be formed of one or more polymers, non-conductive high temperature material that can be exposed to reflow temperatures, etc. Further, for example, the carrier may be formed of Kapton polyimide, cirlex, FR4, etc.

The plurality of openings 33 defined through the carrier 31 are arranged such that each opening aligns with a corresponding contact element 86 (e.g., ball or sphere of a ball grid array) of the packaged device 80. As such, for example, the plurality of openings 33 may be arranged and/or distributed in an array along x and y axes orthogonal to the adapter axis 13 to correspond to contact elements 86 distributed in such a manner or the plurality of openings 33 may be arranged and/or distributed along a region distal from the center of the carrier 31 to correspond to contact elements 86 distributed in such a manner at the perimeter of the package device 80. However, any arrangement of contact elements 86 may be accommodated according to the present disclosure with use of an arrangement of the plurality of openings 33 which are aligned therewith.

Further, in one or more embodiments, each opening of the plurality of openings 33 defined through the carrier 31 is sized for contact with a corresponding contact element 86. For example, where the packaged device 80 includes a ball grid array having a plurality of balls or spheres 86 at the lower surface 84 thereof, each of the plurality of openings 33 defined through the carrier 31 may be a cylindrical opening having a diameter sized to receive a ball/sphere of the packaged device 80. For example, the diameter of such openings 33 may be in the range of about 0.006 inches to about 0.045 inches depending on the pitch of the openings (i.e., the distance between adjacent openings). In other words, at least in one embodiment, the conductive elastomer 35 is a flexible cylindrical suspended pad within the opening 33.

Within each of the plurality of openings 33, conductive elastomer 35 is suspended therein. For example, in one or more embodiments, the conductive elastomer 35 is suspended such that the first and second sides 131, 133 are free of any conductive elastomer. In other words, the conductive elastomer 35 is attached (e.g., by thermal bonding, UV curing, atmospheric curing, etc.) to the inner walls 36 defining the openings 33 as shown, for example, in FIG. 3D. For example, such conductive elastomer 35 may be described as being suspended in an array of holes or openings provided in a matrix form.

The conductive elastomer 35 may be any suitable conductive elastomer material including, for example, any conductive polymer, any conductive flowable material having a plurality of conductive particles distributed therein, silver particle conductive epoxy, gold particle conductive epoxy, etc. In at least one embodiment, the conductive elastomer material may include a flexible epoxy having a plurality of conductive particles distributed therein (e.g., silver particles or balls, gold particles or balls, etc.; having a particle size in the range of about 3 microns to about 10 microns), electrically conductive RTV silicone, or any like conductive epoxy having a certain degree of flexibility (e.g., to provide certain degree of movement from its normal state when suspended in the opening).

Further, in one or more embodiments, the conductive elastomer 35 suspended in each of the plurality of openings 33 may include a curable conductive elastomer material. For example, the elastomer material may be flowable such that it can be provided within each of the plurality of openings 33 and then cured therein (e.g., such as by thermal, chemical, or other curing processes). Such curing may result in the suspended conductive elastomer 35 having a concave surface at the second side 133 of the carrier 31 (e.g., which may more effectively receive a sphere/ball of a ball grid array).

At least in one embodiment, conductive elastomer 35 suspended in each of the plurality of openings 33 is a flexible conductive material such that the suspended conductive elastomer 35 in each of the plurality of openings 33 is flexed towards the first side 131 of the carrier 31 when a force is applied to the packaged device 80 (e.g., such as with use of floating member 40). In other words, at least in one embodiment, when the contact element 86 (e.g., a ball/sphere) is in contact with the suspended conductive elastomer 35 as shown in FIG. 2E and the force is applied to the packaged device 80, a compression force is also applied to the suspended conductive elastomer 35 resulting in the flexing of the suspended conductive elastomer 35 beyond the first side 131 of the carrier 31 and providing effective contact for the contact element 86 through the conductive elastomer 35 to the contact pad 92 of the target board 90 (e.g., moved from its normal state to a flexed state due to the compression force being applied, and then returning to its normal state when the compression force is removed). In such a case when compression is applied (e.g., in its flexed state), for example, the suspended conductive elastomer 35 may take the form of a concave shape at the second side 133 of the carrier 31 and a convex shape at the first side 131 of the carrier 31. By providing a highly resilient elastomer, thousands of compression cycles can be accommodated.

Further, as shown in FIGS. 1-2, the adapter assembly 10 may further include additional guiding and/or alignment apparatus such as a ball guide 50 adjacent conductive elastomer interconnect 30 (e.g., along axis 13) and upon which the packaged device 80 may be received within socket cavity 15. In at least one embodiment, the ball guide 50 may include a plurality of openings 51 defined from the first side 151 thereof adjacent carrier 31 to a second side 153 adjacent a received package device 80. The ball guide 50, at least in one embodiment, may include parallel first and second sides and have a thickness in the range of about 0.002 inches to about 0.007 inches. Further, the ball guide 50 may be formed of one or more layers of any suitable material (e.g., non-conductive material). For example, the ball guide may be formed of one or more polymers or any other electrically non-conductive material or insulative material. Further, for example, the ball guide may be formed of Kapton polyimide, FR4, etc.

Providing such a ball guide 50 may prevent too large of a compression force being applied to the suspended conductive elastomer 35 in the openings 33 of the carrier 31. For example, as shown in FIG. 2E, the thickness of the ball guide 50 may be such (e.g., depending on the size of the ball/sphere 86) that, when the first side 151 of the ball guide 50 contacts the second side 133 of the carrier 31 and the second side 153 of the ball guide 50 contacts the lower surface 84 of the packaged device 80, over compression on the suspended conductive elastomer 35 in the opening 33 is prevented.

The plurality of openings 51 defined through the ball guide 50 are arranged such that each opening aligns with a corresponding contact element 86 (e.g., ball or sphere of a ball grid array) of the packaged device 80. As such, for example, the plurality of openings 51 may be arranged and/or distributed in an array along x and y axes orthogonal to the adapter axis 13 to correspond to contact elements 86 distributed in such a manner or the plurality of openings 51 may be arranged and/or distributed along a region distal from the center of the ball guide to correspond to contact elements 86 distributed in such a manner at the perimeter of the package device 80. However, any arrangement of contact elements 86 may be accommodated according to the present disclosure with use of an arrangement of the plurality of openings 51 which are aligned therewith.

In at least one embodiment, the ball guide 50 may take form of the carrier 31 without the conductive elastomer suspended in the openings thereof. Further, for example, in one or more embodiments, each opening of the plurality of openings 51 defined through the ball guide 50 may be sized for allowing a corresponding contact element 86 to pass therethrough and contact the suspended conductive elastomer 35 in the opening 33 of the carrier 31. For example, where the packaged device 80 includes a ball grid array having a plurality of balls or spheres 86 at the lower surface 84 thereof, each of the plurality of openings 51 defined through the ball guide 50 may be a cylindrical opening having a diameter sized to allow a ball/ sphere of the packaged device 80 to pass therethrough. For example, the diameter of such openings 51 may be in the range of about 0.005 inches to about 0.045 inches.

Figure 3A:
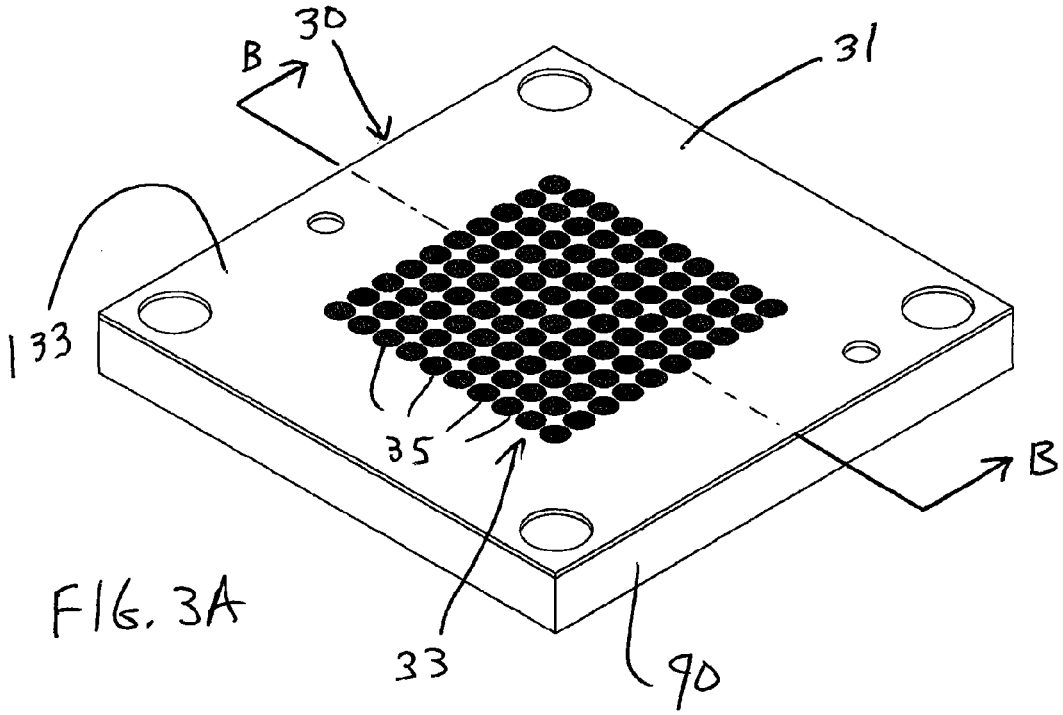
FIG. 3A is a top perspective view of one exemplary embodiment of a conductive elastomer interconnect on a target board for use in a packaged device adapter assembly such as that shown in FIGS. 1-2.
Figure 3B:
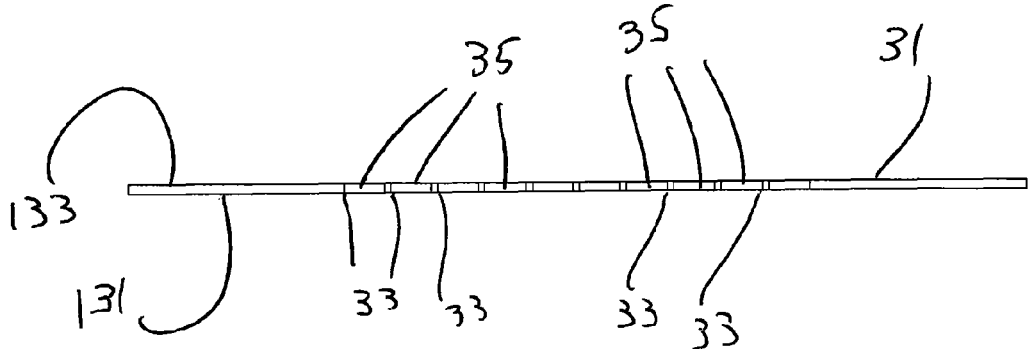
FIG. 3B is cross-sectional side view of the conductive elastomer interconnect shown in FIG. 3A taken along line BB.
Figure 3C:
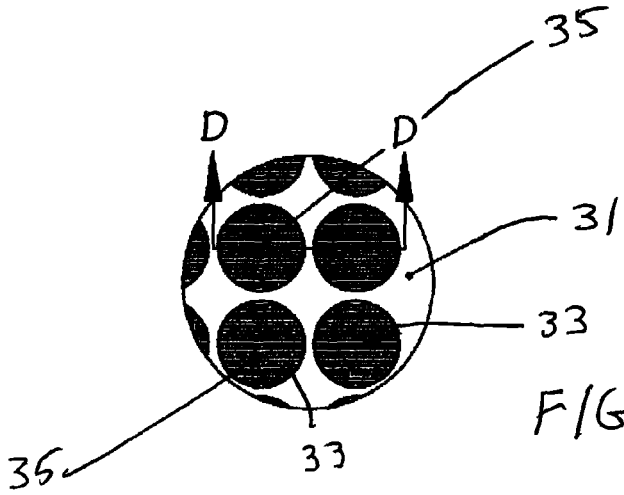
FIG. 3C is a plan view of a portion of the conductive elastomer interconnect of FIGS. 3A-3B.
Figure 3D:
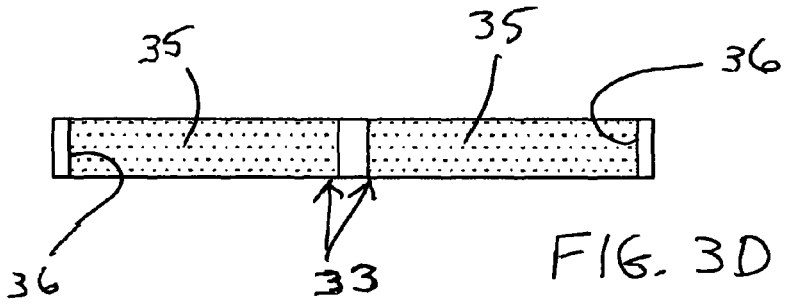
FIG. 3D is a cross-section side view of a portion of the conductive elastomer interconnect shown in FIG. 3C taken along line DD.
Figure 4:
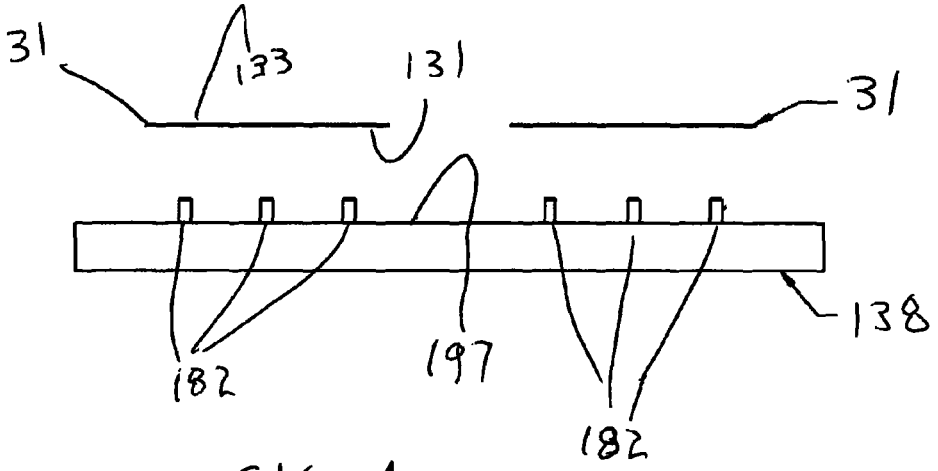
FIG. 4 is a side view for use in illustrating the formation of an exemplary conductive elastomer interconnect such as shown in FIGS. 1-3.

As described herein, the conductive elastomer interconnect 30 for the adapter assembly 10, at least in one embodiment, may be positioned at the first end region 14 of the adapter assembly 10 orthogonal to the adapter axis 13 to define the socket cavity 15 with the one or more wall numbers 12. The conductive elastomer interconnect 30 may be formed in any suitable manner before being assembled to form the socket cavity 15. In one embodiment, as shown in FIG. 4, the conductive elastomer interconnect 30 may be formed by positioning the first side 131 of carrier 31 adjacent a formation surface 197 of a fill plate 138. For example, one or more alignment pins 182 may be used to position multiple carriers 31 on the formation surface 197. At least in one embodiment, the formation surface 197 is a planar surface which closes the plurality of openings 33 defined through the carrier 31. A flowable conductive elastomer is then provided within the plurality of openings 33 defined through the carrier 31. The conductive elastomer within the plurality of openings 33 may then be cured (e.g., by thermal curing, UV curing, atmospheric curing, etc.) to provide the suspended conductive elastomer 35 in each of the plurality of openings 33. In such a manner, for example, the conductive elastomer 35 fills the defined opening 33 with the conductive elastomer 35 having a surface that is flush with the first side 131 of the carrier 31 as shown in FIG. 3D.

At least in one embodiment, silver particles are dispersed in silicone paste to provide the conductive elastomer (e.g., a two part composition including a base material and a catalyst). When the material is to be provided into the openings 33 in the carrier 31, the base material and catalyst are added together and mixed (e.g., with centrifugal movement) to make a consistent paste. The paste may then be provided onto the carrier 31 (e.g., screened onto the carrier 31). For example, a flexible member (e.g., a rubber member or squeegee) may be used to force the paste into the openings 33 such that they are filled equally. The flexible member may be moved left to right and top to bottom several times to provide the fill in the openings 33 and to remove any excess paste. The carrier 31 may then be cured (e.g., thermally cured in an oven, for example, at 150 degrees C. for 30 minutes; or at room temperature, for example, for one day).

Figure 5A:
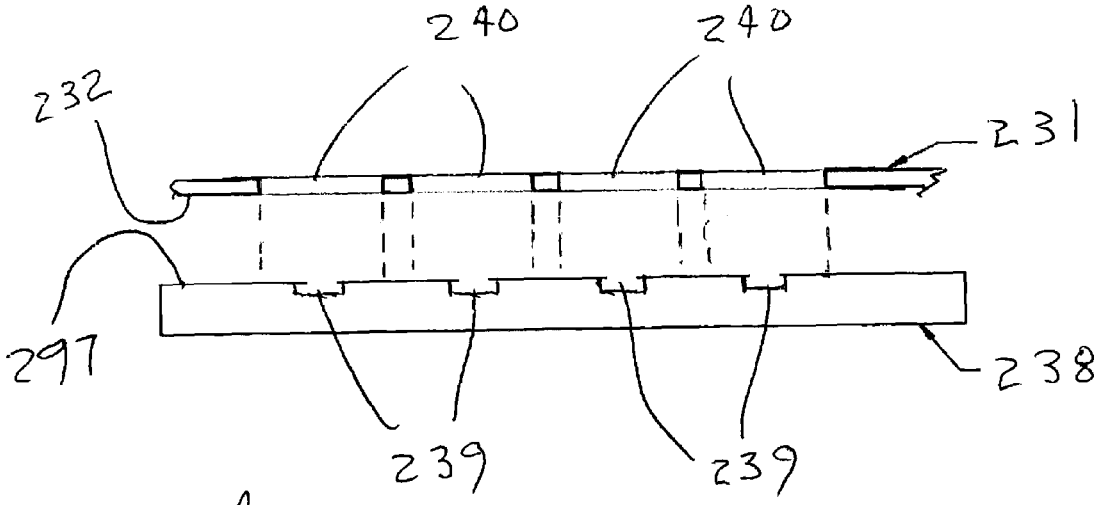
FIG. 5A is a side view for use in illustrating the formation of a portion of another exemplary conductive elastomer interconnect.
Figure 5B:
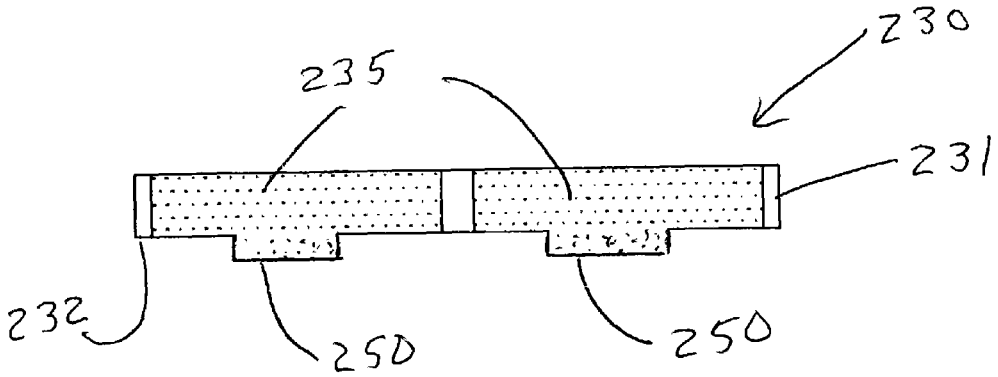
FIG. 5B shows an illustrative cross-section of a portion of the exemplary conductive elastomer interconnect formed as illustrated in FIG. 5A.

FIGS. 5A-5B show an alternate process of forming a conductive elastomer interconnect 230 including conductive elastomer 235 suspended in a plurality of openings 240 of a carrier 231. For example, a first side 232 of carrier 231 is positioned adjacent a fill plate 238. However, unlike the fill plate 138 shown in FIG. 4, fill plate 238 includes at least one surface deformation 239 defined in formation surface 297 (e.g., using a mask and etch process, or in any other manner, physical or chemical) corresponding to each of the plurality of openings 240 defined through the carrier 231. When flowable elastomer material fills the opening 240, the deformation 239 is also filled. When cured, the elastomer material in the at least one surface deformation 239 forms a contact projection 250 of conductive elastomer extending beyond the first side 232 of the carrier 231. The contact projection 250 may provide more effective electrical contact between the conductive elastomer 235 and a contact pad of the plurality of contact pads 92 of the target board 90 when the target board 90 is positioned adjacent to the first side 232 of the carrier 231. In other words, the formation surface 297 is a nonplanar formation surface configured to provide contact projections 250.

One will recognize that various processing steps may be used in the formation of the conductive elastomer interconnects described herein. For example, overfilling holes may be permitted with subsequent planarization or other processes to remove undesirable material, varies masking and etching processes may be used to form openings and or deformations in surfaces, openings may be formed by mechanical drilling or laser drilling, etc.

All patents, patent documents, and references cited herein are incorporated in their entirety as if each were incorporated separately. This disclosure has been described with reference to illustrative embodiments and is not meant to be construed in a limiting sense. As described previously, one skilled in the art will recognize that various other illustrative adapter assembly embodiments may be provided which utilize various combinations of the elements described herein. Various modifications of the illustrative embodiments, as well as additional embodiments of the disclosure and combinations of various elements herein, will be apparent to persons skilled in the art upon reference to this description. It is therefore contemplated that the patented claims will cover any such modifications or embodiments that may fall within the scope of the present disclosure as defined by the accompanying claims.

What is claimed is:

1. An adapter apparatus for receiving a packaged device having a plurality of contact elements disposed on a surface thereof, the adapter apparatus comprising:

a conductive elastomer interconnect comprising:

a carrier comprising a plurality of openings defined therethrough from a first side to a second side thereof by inner walls, wherein the plurality of openings are arranged to align with the plurality of contact elements of the packaged device, and conductive elastomer suspended in each of the plurality of openings by attachment to the inner walls to contact a contact element of a plurality of contact elements of a packaged device when positioned adjacent the second side of the carrier; and one or more adapter wall members along an adapter axis between a first end region of the adapter apparatus and a second end region of the adapter apparatus, wherein the conductive elastomer interconnect is positioned at the first end region of the adapter apparatus orthogonal to the adapter axis, and further wherein the one or more adapter wall members and the conductive elastomer interconnect define a socket cavity adapted to receive the packaged device with the plurality of contact elements thereof adjacent the conductive elastomer suspended in each of the plurality of openings.

2. The adapter apparatus of claim 1, wherein the first and second sides of the carrier are free of conductive elastomer.

3. The adapter apparatus of claim 1, wherein the packaged device comprises a ball grid array comprising a plurality of balls, and further wherein each opening of the plurality of openings defined through the carrier is a cylindrical opening having a diameter sized to receive a ball of the plurality of balls of the ball grid array.

4. The adapter apparatus of claim 1, wherein the conductive elastomer suspended in each of the plurality of openings comprises a curable conductive elastomer material, wherein the curable conductive elastomer material comprises a plurality of conductive particles.

5. The adapter apparatus of claim 1, wherein the conductive elastomer suspended in each of the plurality of openings comprises a concave surface at the second side of the carrier for electrical contact with the contact elements of the packaged device.

6. The adapter apparatus of claim 1, wherein the conductive elastomer suspended in each of the plurality of openings comprises a contact projection extending beyond the first side of the carrier for electrical contact with a contact pad of a plurality of contact pads of a target board when the target board is positioned adjacent the first side of the carrier.

7. The adapter apparatus of claim 1, wherein the one or more wall members comprise alignment structure positioned at the first end region to align the packaged device within the socket cavity, wherein the alignment structure comprises at least an alignment plate positioned orthogonal to the adapter axis, wherein the alignment plate comprises a plurality of openings arranged to align with the plurality of contact elements of the packaged device and adapted to allow contact elements of the packaged device to be in electrical contact with the conductive elastomer suspended in each of the plurality of openings defined in the carrier layer.

8. The adapter apparatus of claim 1, wherein adapter apparatus further comprises an actuator apparatus comprising a floating member movable in the socket cavity and an actuator element, wherein the actuator element is operable to provide a force on the floating member resulting in a corresponding force being distributed to the packaged device when received in the socket cavity such that the plurality of contact elements are in electrical contact with the suspended conductive elastomer in each of the plurality of openings defined in the carrier, wherein the suspended conductive elastomer in each of the plurality of openings defined in the carrier is flexed towards the first side of the carrier when the force is applied.

9. An apparatus for use in an adapter configured to receive a packaged device having a plurality of contact elements disposed on a surface thereof, the apparatus comprising a conductive elastomer interconnect comprising:

a carrier comprising a plurality of openings defined therethrough from a first side to a second side thereof by inner walls, wherein the plurality of openings are arranged to align with the plurality of contact elements of the packaged device; and conductive elastomer suspended in each of the plurality of openings by attachment to the inner walls to contact a contact element of a plurality of contact elements of a packaged device when positioned adjacent the second side of the carrier.

10. The apparatus of claim 9, wherein the first and second sides of the carrier are free of conductive elastomer.

11. An apparatus for use in an adapter configured to receive a packaged device having a plurality of contact elements disposed on a surface thereof, the apparatus comprising a conductive elastomer interconnect comprising:

a carrier comprising a plurality of openings defined therethrough from a first side to a second side thereof, wherein the plurality of openings are arranged to align with the plurality of contact elements of the packaged device; and conductive elastomer suspended in each of the plurality of openings to contact a contact element of a plurality of contact elements of a packaged device when positioned adjacent the second side of the carrier, wherein the packaged device comprises a ball grid array comprising a plurality of balls, and further wherein each opening of the plurality of openings defined through the carrier is a cylindrical opening having a diameter sized to receive a ball of the plurality of balls of the ball grid array.

12. The apparatus of claim 9, wherein the conductive elastomer suspended in each of the plurality of openings comprises a curable conductive elastomer material, wherein the curable conductive elastomer material comprises a plurality of conductive particles.

13. The apparatus of claim 9, wherein the conductive elastomer suspended in each of the plurality of openings comprises a concave surface at the second side of the carrier for electrical contact with the contact elements of the packaged device.

14. An apparatus for use in an adapter configured to receive a packaged device having a plurality of contact elements disposed on a surface thereof, the apparatus comprising a conductive elastomer interconnect comprising:

a carrier comprising a plurality of openings defined therethrough from a first side to a second side thereof, wherein the plurality of openings are arranged to align with the plurality of contact elements of the packaged device; and conductive elastomer suspended in each of the plurality of openings to contact a contact element of a plurality of contact elements of a packaged device when positioned adjacent the second side of the carrier, wherein the conductive elastomer suspended in each of the plurality of openings comprises a contact projection extending beyond the first side of the carrier for electrical contact with a contact pad of a plurality of contact pads of a target board when the target board is positioned adjacent the first side of the carrier.

15. An apparatus for use in an adapter configured to receive a packaged device having a plurality of contact elements disposed on a surface thereof, the apparatus comprising a conductive elastomer interconnect comprising:

a carrier comprising a plurality of openings defined therethrough from a first side to a second side thereof, wherein the plurality of openings are arranged to align with the plurality of contact elements of the packaged device; and conductive elastomer suspended in each of the plurality of openings to contact a contact element of a plurality of contact elements of a packaged device when positioned adjacent the second side of the carrier, wherein the suspended conductive elastomer in each of the plurality of openings defined in the carrier is flexed towards the first side of the carrier when a force is applied via a packaged device positioned adjacent the second side of the carrier.

16. A method of providing an adapter apparatus adapted to receive a packaged device having a plurality of contact elements disposed on a surface thereof, the adapter apparatus mountable to a target board to electrically connect the plurality of contact elements to a plurality of contact pads of the target board, wherein the method comprises:

providing a conductive elastomer interconnect, the conductive elastomer interconnect comprising:

a carrier comprising a plurality of openings defined therethrough from a first side to a second side thereof by inner walls, wherein the plurality of openings are arranged to align with the plurality of contact elements of the packaged device, and conductive elastomer suspended in each of the plurality of openings by attachment to the inner walls to contact a contact element of a plurality of contact elements of a packaged device when positioned adjacent the second side of the carrier; and providing one or more adapter wall members along an adapter axis between a first end region and a second end region of the adapter apparatus; and positioning the conductive elastomer interconnect at the first end region of the adapter apparatus orthogonal to the adapter axis to define a socket cavity of the adapter apparatus adapted to receive a packaged device such that the plurality of contact elements of the packaged device are adjacent the conductive elastomer suspended in each of the plurality of openings.

17. The method of claim 16, wherein providing a conductive elastomer interconnect comprises:

positioning the first side of the carrier adjacent a formation surface to close the plurality of openings defined through the carrier; and providing conductive elastomer at least within the plurality of openings defined through the carrier; and curing the conductive elastomer within the plurality of openings to provide the suspended conductive elastomer in each of the plurality of openings.

18. The method of claim 17, wherein the formation surface is planar.

19. The method of claim 17, wherein the formation surface comprises a least one surface deformation defined therein corresponding to each of the plurality of openings defined through the carrier, wherein the at least one surface deformation forms a contact projection of the suspended conductive elastomer extending beyond the first side of the carrier for electrical contact with a contact pad of a plurality of contact pads of a target board when the target board is positioned adjacent the first side of the carrier.

20. The method of claim 16, wherein the method further comprises:

providing an actuator apparatus comprising a floating member movable in the socket cavity and an actuator element, wherein the actuator element is operable to provide a force on the floating member such that a corresponding force is distributed to a packaged device when received in the socket cavity; and providing electrical contact between the plurality of contact elements of the packaged device and the suspended conductive elastomer in each of the plurality of openings defined in the carrier via the force provided on the floating member, wherein the suspended conductive elastomer in each of the plurality of openings defined in the carrier is flexed towards the first side of the carrier when the force is applied.

* * * * *